United States Patent [19]

Dockerill

[11] 4,068,518

[45] Jan. 17, 1978

[54] METHOD OF MANUFACTURING AN EXTRUDED STEEL COMPONENT

[75] Inventor: Ian Anthony Dockerill, Solihull, England

[73] Assignee: Lucas Industries Limited, Birmingham, England

[21] Appl. No.: 687,209

[22] Filed: May 17, 1976

[30] Foreign Application Priority Data

May 20, 1975 United Kingdom ..... 21376/75

[51] Int. Cl.[2] ..... B21D 22/00

[52] U.S. Cl. ..... 72/354; 72/359

[58] Field of Search ..... 72/354, 356, 359

[56] References Cited

U.S. PATENT DOCUMENTS

| | | | |
|---|---|---|---|
| 2,066,372 | 1/1937 | Tomalis | 72/356 |
| 3,197,857 | 8/1965 | Nippert | 72/354 X |
| 3,413,945 | 12/1968 | Bertoglio | 72/356 X |
| 3,434,326 | 3/1969 | Serret | 72/359 |

*Primary Examiner*—Leon Gilden

*Attorney, Agent, or Firm*—Holman & Stern

[57] ABSTRACT

A method of manufacturing an extruded steel component for use in a roller clutch assembly comprises initially providing a steel preform which defines a hollow shank part of the required component and which includes a hollow head portion tapering inwardly to the shank part, the external diameter of the head portion being substantially equal to the external diameter of a hollow head part of the required component, but the bore in the head portion having a diameter less than that required for the head part. Then with the preform positioned in a die cavity of the shape of the required component, an extrusion operation is performed on the head portion of the preform using a punch including inner and outer, relatively movable punch members, the inner punch member defining the shape of the bore required in the head part of the component. During the extrusion operation, the inner punch member is moved relative to the outer punch member and the die cavity so as to enter the head portion and produce the bore required in the head part of the component and a cam surface on the wall of the bore in the head part. The outer punch member defines the shape of the free end of the head part of the required component, and during the extrusion operation, is urged to apply a predetermined load to the head portion of the preform so as to restrict the flow of material extruded from the preform by the inner punch member, the material thereby being constrained to fill the region of the die cavity defining the head part of the component.

8 Claims, 7 Drawing Figures

METHOD OF MANUFACTURING AN EXTRUDED STEEL COMPONENT

This invention relates to a method of manufacturing an extruded steel component for use in a roller clutch assembly, the component being of the kind including a sleeve having a head part and a shank part, the bore in the sleeve being stepped to define a wide portion within the head part and a narrow portion within the shank part, and the wall of said wide portion of the bore being shaped to define an internal cam surface in the head part.

A method, according to the invention, includes the steps of:

a. producing a steel preform which defines the shank part of the required component and which includes a hollow head portion tapering inwardly to the shank part, the external diameter of the head portion being substantially equal to the external diameter of the head part of the required component, but the bore in the head portion having a diameter less than that required for said head part, and b. with the preform positioned in a die cavity of the shape of the required component, performing an extrusion operation on the head portion of the preform using a punch including inner and outer, relatively movable punch members, the inner punch member defining the shape of the wide portion of said bore in the required component and, during the extrusion operation, being moved relative to the outer punch member and the die cavity so as to enter said head portion and produce said wide bore portion and said cam surface, and the outer punch member defining the shape of the free end of the head part of the required component and, during the extrusion operation, being urged to apply a predetermined load to the head portion of the preform so as to restrict the flow of metal extruded from the preform by said inner punch member, said material thereby being constrained to fill the region of the die cavity defining the head part of the component.

Preferably, step (b) is arranged to produce a plurality of angularly spaced ribs integral with the head part and extending inwardly from the wall of said wide portion of the bore.

Preferably, the tapering head portion of the preform defines an included angle of between 80° and 100°.

Preferably, the preform is produced by effecting the following steps in order:

c. cropping a steel bar to produce a slug havng a length to diameter ratio of not less then 0.75, d. deforming a slug into a substantially cylindrical billet having a diameter substantially equal to the diameter of the head part of the sleeve, e. heat treating the billet to remove work hardening, f. forming an axially extending, centrally disposed bore in the billet, and g. positioning the billet in a further die cavity defining the external shape of the preform and using a further punch to perform an extrusion process on the billet such that metal flows in the direction of movement of the punch and produces said preform.

Preferably, the preform produced after step (g) is heat treated to remove work hardening before being subjected to step (b).

Preferably, the minimum length to diameter ratio of the cropped slug is 1.

Preferably, the length of the slug is reduced by at least 30% during the deforming step (d).

Preferably, step (f) is effected by an extrusion operation followed by a piercing operation.

In the accompanying drawings, which illustrate one example of the invention,

Figure 1:
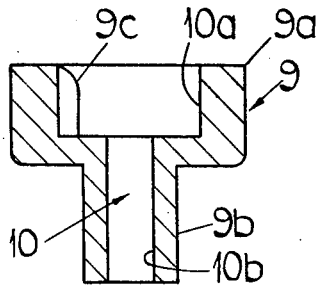
FIG. 1 is a sectional view of a component for use in a roller clutch assembly.
Figure 2:
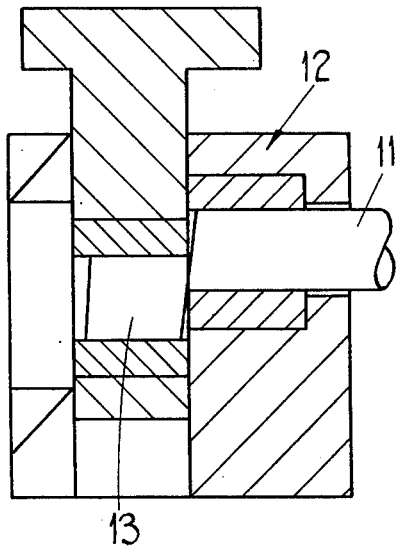
FIGS. 2 to 6 are sectional views illustrating five stages respectively during a method of producing the component shown in FIG. 1.

Referring to the drawings in the example shown it was required to manufacture a component for use in a roller clutch assembly, the component being of the kind including a stepped, cylindrical sleeve 9 having a head part 9*a* and a shank part 9*b*. The bore 10 in the sleeve was stepped to define a wide portion 10*a* in the head part 9*a* and a narrow portion 10*b* in the shank part 9*b*. Also the wall of the wide portion 10*a* of the bore 10 defined an internal cam surface (not shown) in the head part 9*a* and a plurality of inwardly extending, angularly spaced ribs 9*c*. It is to be appreciated that when the component was in use in a roller clutch assembly, each of the ribs 9*c* defined an abutment against which a spring was flexed so as to urge a roller into engagement with the cam surface on the wall of the wide portion 10*a* of the bore 10.

Figure 3:
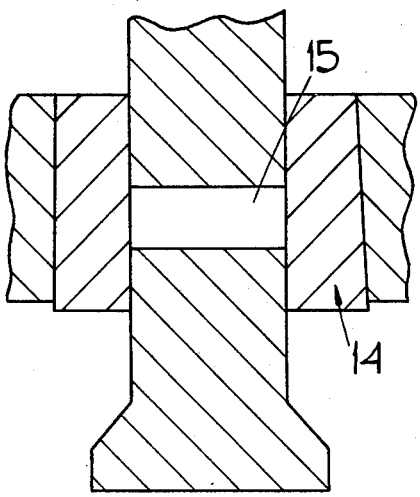
Figure 4:
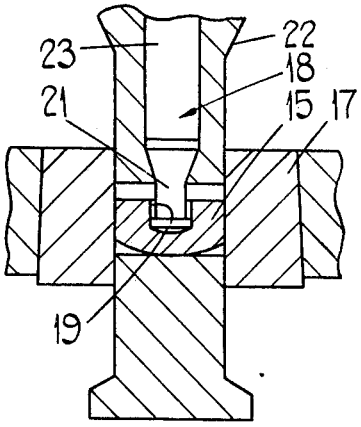

As shown in FIGS. 2 to 6, the component was manufactured from a centerless, turned steel bar 11, the steel used in the bar 11 having the following composition by weight: carbon 0.21%, manganese 1.24%, silicon 0.3%, sulphur 0.033%, phosphorus 0.06%, nickel 0.13%, chromium 0.23%, molybdenum 0.15%, copper 0.15%, and the remainder being iron. The bar 11 was cropped by means of a tool 12 (FIG. 2) so as to produce a slug 13, the feeding of the bar 11 into the cropping tool 12 being controlled by means of a fixed stop (not shown) so that the cropping operation produced a slug 13 of constant weight, the weight of the slug formed being determined by the volume of the slug necessary to produce a finished component of the desired dimensions. In one practical embodiment the tool 12 was arranged to produce a slug 13 having a weight of between 215 and 220 gm, the length of the slug being 1.24 inches and the diameter of the slug being 1.26 inches. As shown in FIG. 3, the slug 13 was then deformed by a press 14 into a billet 15 shaped so that the periphery of the billet 15 defined a substantially cylindrical surface with the diameter of the billet being substantially equal to the required head diameter of the finished component, which in said one practical embodiment was 1.832 inches. Deforming of the slug 13 also reduced the length of the slug to a value of 0.676 inch for the billet 15.

Figure 5:
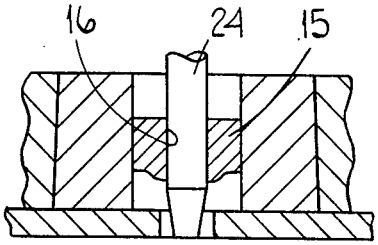
Figure 6:
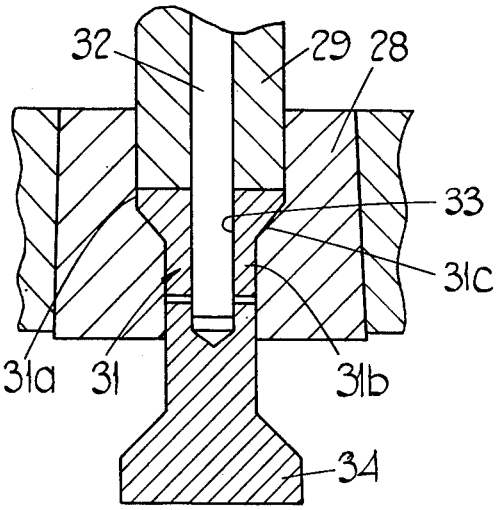

To effect the deforming operation a load of 260 tons was applied to the punches of the press 14 and after formation of the billet 15, a spheroidizing heat treatment process was carried out by heating the billet for 4 hours at 680° C. Lubrication was then applied to the billet by a standard phosphating and soaping application, whereafter an axially extending, centrally disposed bore 16 was formed in the billet 15 by a combination of an extrusion operation (FIG. 4) and a piercing operation (FIG. 5). Thus the lubricated billet was first positioned in a die 17 and, using a two part punch 18, an impact extrusion operation was performed on the billet 15 to produce a blind bore 19 in the billet. The tip 21 of the punch 18 was formed of tungsten carbide sold by Wickman Wimet as grade C.T., which contained 9% by weight of cobalt, had a grain size of 3 microns, and a density of 14.65 gm/c.c. A tool steel punch holder 22 supported the carbide punch tip 21 and a high speed steel backing piece 23 formed the other part of the two-part punch 18. In said one practical embodiment, a load of 48 tons was applied to the punch 18 to effect the bore extrusion and, in view of the considerable stresses which were experienced by the tip 21 during the extrusion operation, it will be seen from FIG. 4 that the tip 21 was shaped to minimize these stresses. Formation of the bore 16 was then completed by piercing the blind bore 19 using the tool shown at 24 with an applied load of 20 tons. The resultant billet had an external diameter of 1.839 inches, an axial length of 0.800 inch and a bore diameter of 0.662 inch.

The pierced billet was then heat treated to recrystallize the work hardened ferrite grains in the steel by passing the billet through a conveyor furnace at a speed at 2.5 inches per minute with the furnace temperature being held at 710°–720° C and the furnace being supplied with exothermic gas. After recrystallization the billet 15 was lubricated using a standard phosphating and soaping treatment and was then positioned in a die 28 (FIG. 6) where an extrusion process was carried out on the billet 15 by applying a load of 284 tons to the billet through a first extrusion punch 29. During the extrusion process metal flowed from the billet 15 in the direction of movement of the punch 29. The die 28 was arranged so that the extrusion produced a preform 31 having a shank portion 31*b*, defining the shank part 9*b* of the required component, and a head portion 31*a* of external diameter equal to the external diameter of the head part 9*a* of the required component. The extrusion process also produced a tapering portion 31*c* joining the head portion 31*a* and the shank portion 31*b*, the taper of the portion 31*c* being such that the included angle of the taper was 80°. Also, a mandrel 32 extending through the punch 29 was received in the bore 16 in the billet 15 during the extrusion process so that the extrusion produced a bore 33 in the preform 31. The bore 33 was of substantially the same diameter as that required for the narrow portion 10*b* of the bore in the sleeve 9, though the mandrel 32 was arranged to impart a slight taper to the bore 33 so as to allow the mandrel to be removed from the preform after extrusion without the preform being removed from the die 28.

Figure 7:
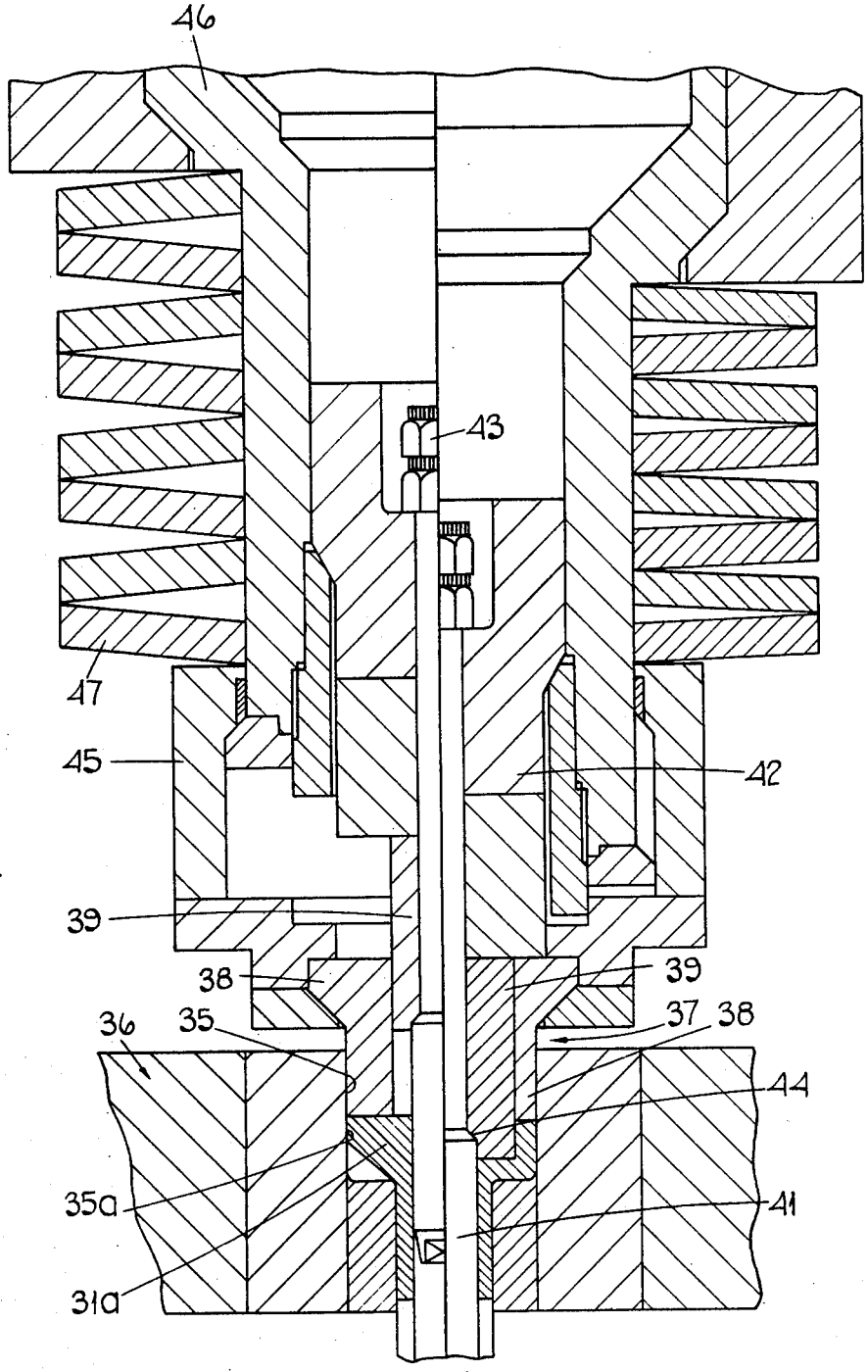
FIG. 7 is a composite sectional view illustrating two further stages during the method of producing the component shown in FIG. 1.

When the extrusion of the preform 31 was complete and the punch 29 and mandrel 32 had been removed from the die 28, the preform 31 was ejected from the die by means of an ejector punch 34 and subsequently was heat treated at 680° C for 4 hours. The preform 31 was then lubricated by a standard phosphating and soaping treatment and subsequently was positioned in the die cavity 35 of a further extrusion die 36 (FIG. 7). The die cavity 35 defined the shape of the sleeve 9 and hence included a wide portion 35*a* which received the head portion 31*a* of the preform and a narrow portion 35*b* which received the shank portion 31*b*. At this stage, of course, the head portion 31*a* did not conform to the shape of the wide portion 35*a* of the die cavity and hence an extrusion operation was performed on the head portion 31*a* using the two part punch shown at 37 in FIG. 7. The two parts of the punch 37 were movable relative to one another and consisted of an outer punch member 38 defining the shape of the free end of the head part 9*a* of the required component and an inner punch member 39 defining the shape of the wide bore portion 10*a* together with the cam surface and the ribs 9*c*. In addition, the punch 37 included a mandrel 41 projecting from the inner punch member 39 and supported by a backing member 42, the mandrel being clamped against the member 42 by locking nuts 43 so that a shoulder 44 on the mandrel trapped the punch member 39 against the backing member 42. The portion of the mandrel 41 projecting from the punch member 39 had a diameter equal to that required for the narrow portion 10*b* of the bore in the sleeve 9.

The punch 37 formed part of a movable press tool, which also included a lower carrier assembly 45 supporting the outer punch member 38 and an upper carrier assembly 46 supporting the inner punch member 39 and backing member 42. Trapped between the assemblies 45, 46 were eight Belleville washers 47 which were stacked in series and which urged the assembly 46 to a rest position in which the inner punch member 39 was withdrawn from the free end of the outer punch member 38. In said one practical embodiment, each washer 37 had an external diameter of 7.87 inches, an internal diameter of 4.02 inches and the overall stiffness of the stack of washers was 10.8 tons f/inch.

To effect extrusion of the head part 31*a* of the preform 31, the punch 37 was caused to enter the die cavity until the outer punch member 38 engaged the free end of the head portion. At this stage, the assembly 46 was in its rest position and hence the inner punch member 39 was spaced from the preform 31. A load was then applied to the assembly 46 so as to move the latter towards the assembly 45 against the action of the washers 47 which were therefore compressed. The punch member 38 thereby applied a load to the free end of the head portion 31*a* while at the same time, by virtue of the movement of the assembly 46, the inner punch member 39 was moved into the die cavity 35. As the punch member 39 moved into the die cavity, it engages the head portion 31*a* whereafter it entered the head portion so as to displace material therefrom. Flow of displaced material was opposed by the outer punch member 38, which thereby caused the material to conform accurately to the shape of the wide portion 35*a* of the die cavity. In this way, it was found that the extruded component accurately defined the shape of the head part of the required sleeve 9, and in particular the shape of the cam surface, so that it was unnecessary to subject the extruded component to a final machining operation.

In said one practical embodiment, the press associated with the punch 37 applied a load of 7–8 tons force to the assembly 46 at the start of the working stroke of the press, this load of course increasing during the working stroke so as to overcome the stiffness of the stacked washers 47. It was, however, important to ensure that the load applied to the punch 37 did not exceed 13 tons force, which was conveniently effected by providing between the die 36 and the base of the press a further stack of washers (not shown) to take up any excess loading.

I claim:

1. A method of manufacturing an extruded steel component, including the steps of:

a. producing a steel preform which defines a shank part of a required component and which includes a hollow head portion tapering inwardly to the shank part, the external diameter of the head portion being substantially equal to the external diameter of the head part of the required component, but the bore in the head portion having a diameter less than that required for said head part, and b. positioning the preform in a die cavity of the shape of the required component, and performing an extrusion operation on the head portion of the preform using a punch including inner and outer, relatively movable punch members, the inner punch member defining the shape of the wide portion of said bore in the required component and the head part of the outer punch member defining the shape of the free end of the required component, the extrusion operation comprising moving the inner punch member relative to the outer punch member and the die cavity so as to enter said head portion and produce said wide bore portion and a cam surface on the wall of the bore in the head part, and urging the outer punch member against the free end of the head portion to apply a predetermined load to the head portion of the preform so as to restrict the flow of material extruded from the preform by said inner punch member, said material thereby being constrained to fill the region of the die cavity defining the head part of the component.

2. The method as claimed in claim 1, wherein step (b) is arranged to produce a plurality of angularly spaced ribs integral witn the head part and extending inwardly from the wall of said wide portion of the bore.

3. The method as claimed in claim 1, wherein the tapering head portion of the preform defines an included angle of between 80° and 100°.

4. The method as claimed in claim 1, wherein the preform is produced by effecting the following steps in order:

c. cropping a steel bar to produce a slug having a length to diameter ratio of not less than 0.75, d. deforming the slug into a substantially cylindrical billet having a diameter substantially equal to the diameter of the head part of the required component, e. heat treating the billet to remove work hardening, f. forming an axially extending, centrally disposed bore in the billet, and g. positioning the billet in a further die cavity defining the external shape of the preform and using a further punch to perform an extrusion process on the billet such that metal flows in the direction of movement of the punch and produces said preform.

5. The method as claimed in claim 4, wherein the preform produced after step (g) is heat treated to remove work hardening before being subjected to step (b).

6. The method as claimed in claim 4 5, wherein the minimum length to diameter ratio of the cropped slug is 1.

7. The method as claimed in claim 4, wherein the length of the slug is reduced by at least 30% during the deforming step (d).

8. The method as claimed in claim 4, wherein step (f) is effected by an extrusion operation followed by a piercing operation.

* * * * *